US008425158B2

(12) United States Patent
Milton et al.

(10) Patent No.: US 8,425,158 B2
(45) Date of Patent: Apr. 23, 2013

(54) CELLULAR CONFINEMENT SYSTEMS

(75) Inventors: Jeremy Milton, Bridport (GB); Basil John Thomas, Gwent (GB)

(73) Assignees: J & S Franklin, Ltd., London (GB); Terram Limited, Pontypool, Gwent (GB)

( * ) Notice: Subject to any disclaimer, the term of this patent is extended or adjusted under 35 U.S.C. 154(b) by 599 days.

(21) Appl. No.: 12/442,756

(22) PCT Filed: Sep. 24, 2007

(86) PCT No.: PCT/GB2007/003630
§ 371 (c)(1),
(2), (4) Date: Mar. 25, 2009

(87) PCT Pub. No.: WO2008/037972
PCT Pub. Date: Apr. 3, 2008

(65) Prior Publication Data

US 2009/0324346 A1 Dec. 31, 2009

(30) Foreign Application Priority Data

Sep. 25, 2006 (GB) ..... 0618868.4
Jun. 27, 2007 (GB) ..... 0712510.7

(51) Int. Cl.
*E02D 17/20* (2006.01)

(52) U.S. Cl.
USPC ..... 405/302.7; 405/302.4; 405/15; 405/284; 404/35

(58) Field of Classification Search ..... 405/15, 405/16, 17, 302.4, 302.6, 302.7, 262, 284; 383/38; 493/391, 966; 220/23.6, 23.86, 220/507; 206/509, 511, 821; 404/35, 36
See application file for complete search history.

(56) References Cited

U.S. PATENT DOCUMENTS

| | | | | |
|---|---|---|---|---|
| 4,530,622 | A | 7/1985 | Mercer | |
| 4,572,705 | A * | 2/1986 | Vignon et al. | 405/16 |
| 4,726,708 | A | 2/1988 | Papetti | |
| 4,797,026 | A | 1/1989 | Webster | |
| 5,927,906 | A | 7/1999 | Bach et al. | |
| 6,893,193 | B2 * | 5/2005 | Santha | 405/302.6 |
| 2004/0151404 | A1 * | 8/2004 | Richardson et al. | 383/16 |
| 2005/0117978 | A1 | 6/2005 | Loffel | |
| 2005/0123355 | A1 * | 6/2005 | Kolenski et al. | 405/184.2 |
| 2006/0147275 | A1 | 7/2006 | Lin et al. | |
| 2006/0147276 | A1 | 7/2006 | Lin et al. | |

FOREIGN PATENT DOCUMENTS

| | | |
|---|---|---|
| CN | 2683703 | 3/2005 |
| CN | 2703793 | 6/2005 |
| EP | 285378 | 10/1988 |
| EP | 378 309 | 7/1990 |
| EP | 378 310 | 7/1990 |
| FR | 2699948 | 7/1994 |

(Continued)

*Primary Examiner* — Sean Andrish
(74) *Attorney, Agent, or Firm* — Diederiks & Whitelaw, PLC

(57) ABSTRACT

A cellular confinement system for soil, sand or other filler material comprises a number of sub-assemblies each made up of a plurality of interconnected open cells of fabric material. The sub-assemblies are stackable one on top of the other to provide a structure having at least one generally vertical side or end wall. The system further comprises sealing means such as one or more skirt portion(s) which are arranged between vertically juxtaposed sub-assemblies in use. The skirt portions substantially prevent or minimize the escape of finer aggregate material from between the stacked sub-assemblies.

20 Claims, 14 Drawing Sheets

FOREIGN PATENT DOCUMENTS

| | | | |
|---|---|---|---|
| FR | 2824340 | | 11/2002 |
| GB | 1 208 205 | | 10/1970 |
| GB | 2029802 | * | 3/1980 |
| WO | 90/12160 | | 10/1990 |
| WO | 03/038196 | | 5/2003 |
| WO | 2005/080691 | | 9/2005 |

* cited by examiner

CELLULAR CONFINEMENT SYSTEMS

CROSS-REFERENCE TO RELATED APPLICATIONS

The present application represents a National Stage application of PCT/GB2007/003630 filed Sep. 24, 2007 entitled "Cellular Confinement Systems."

BACKGROUND OF THE INVENTION

The present invention relates to cellular confinement systems, in particular to three-dimensional cellular structures designed to physically confine soil, sand or other filler materials.

Confinement systems are commonly used in civil engineering applications for land reinforcement, erosion control, embankment stabilisation, retaining structures and channel protection. For example, metal or wicker baskets called gabions which are filled with stones, earth, etc. are used in the construction industry e.g. for shoring up, slopes or forming sea defences.

Cellular confinement systems prevent horizontal movement of the confined material, substantially improving the material shear strength and bearing capacity. They can be used to form access roads, hard standings, embankment slopes, containment dykes and levees, landfill lining and covers, dam faces and spillways, noise abatement walls and parking areas. Alternatively, such cellular systems can be stacked in order to support slopes or construct walls.

In industrial applications confinement cells are traditionally used as a lightweight filler within items to provide additional stiffness and strength. Cellular confinement structures also have military applications such as security and defence barriers.

Confinement systems formed from metal baskets are limited in their applications as the fill material must be large enough to be retained by the basket mesh. Gabions are typically filled with stone which is dressed and laid in the nature of wall so as to have an enhanced appearance when the baskets are left exposed to view. It can therefore be time consuming and labour intensive to provide a visually appealing system e.g. for shoring up an embankment adjacent to a motorway.

It has been proposed in WO 90/12160 to provide structural blocks formed by wire mesh cages which are lined with a geotextile material. By providing the cages with a fabric liner a wider variety of infill materials may be employed, such as soil and sand. However a liner needs to be stapled in place inside each cage. The system can be transported flat and then filled locally upon demand. However, such a composite system has certain drawbacks. Several manufacturing and assembly stages are required and the material cost is relatively high. The system is also relatively bulky and heavy to transport.

For civil engineering applications there are available cellular systems such as those manufactured by Terram Ltd. which are made from various grades of thermally bonded nonwoven geotextile. Such geotextiles have the flexibility of a fabric combined with a high tensile strength and stiffness. They are water permeable so soils are prevented from intermixing while still permitting water to flow freely through the system.

A cellular textile sheet is described in U.S. Pat. No. 4,572,705 and a three-dimensional cellular geotextile is described in FR 2824340.

Geotextile cellular systems can be used to confine all kinds of aggregates, soils, sand, etc. of any particle size. They are commonly used in a single layer to help prevent erosion by confining soil on slopes. Although such cellular systems can be stacked e.g. to form an earth retention structure for embankments, there is a limit to the steepness of wall that can be achieved. This depends on the fill material and cell size as well as the skill and accuracy of placement. Often, each subsequent layer of cells must be stepped back from the layer below in order to stabilise the structure. Using rock or aggregate fill materials a short vertical wall may be possible, but where the confined material is a fine granular fill material such as soil or sand it has been found that leakage occurs between the layers when the cells are stacked vertically. The strength of the system is also dictated by the properties of the geotextile material. In some applications additional reinforcement may be required.

The present invention seeks to mitigate the problems outlined above.

SUMMARY OF THE INVENTION

A first aspect of the invention provides a frameless cellular confinement system for soil, sand or other filler material, the system comprising subassemblies each made up of a plurality of interconnected open cells of fabric material, the sub-assemblies being stackable one on top of the other to provide a structure having at least one generally vertical side or end wall, the system further comprising sealing means which are arranged between vertically juxtaposed sub-assemblies in use to substantially prevent or minimise finer aggregate material escaping from between the stacked sub-assemblies at said generally vertical side or end wall.

By "frameless" it is meant that at least the sub-assemblies of the system are free of a wire mesh or wire cage support assembly. In other words the cells of the cellular subassemblies are directly interconnected by the fabric material itself rather than each fabric cell being located in a respective framed enclosure. In preferred embodiments the entire system is frameless. It is however also envisaged that the system may, for example, be deployed within some form of outer housing or framework. Such a framework may be formed of plastic or metal. Internal support struts might also be provided within the cells, though this is not preferred. Through the use of such an arrangement it has been found that it is possible to erect vertical walled structures of substantial height using a cellular fabric confinement system without the use of a wire mesh or wire cage support. The cells are "open" in that they have no top or base wall, so the filler material is vertically continuous from layer to layer through the cells of said stacked sub-assemblies, leakage of fine filler material being prevented by the sealing means. However, the top and/or bottom subassembly in the stacked system may be provided with cover means to separate the fill material from the external environment.

The sealing means may comprise zips or other fastening means, or tape, arranged along respective lower and/or upper edges of the sub-assemblies at the or each vertical wall. However, in a preferred embodiment such means comprises one or more skirt portion(s). The skirt portions are preferably flexible and/or liquid permeable, as is discussed below. Flexible skirt portions may more easily be tucked inside the cell walls of juxtaposed sub-assemblies. They may also be more conformable and will lie flat against the cell walls, whether on the inside or outside. They may also be better able to bend around cell corners.

The skirt portion or portions may, in some embodiments, be fixedly attached to or integral with the walls of respective cells of an upper one of the sub-assemblies and extend in use down into underlying cells adjacent the generally vertical side or end walls. In other embodiments, a skirt portion or portions may be fixedly attached to or integral with the walls of respective cells of each sub-assembly and may extend in use upwardly into or over overlying cells of an upper sub-assembly. In yet other embodiments the skirt portions may extend in use both upwardly and downwardly from the walls of a respective cellular sub-assembly. As will be explained in more detail below, a skirt portion may provide a seal between one or more sets of vertically superimposed cells.

A second aspect of the invention provides a sub-assembly for a cellular confinement system for soil, sand or other filler material, the sub-assembly formed of a plurality of interconnected cells of fabric material, at least some of the cells being provided with a skirt portion extending from a respective cell wall, said skirt portion being fixedly attached to such wall.

In accordance with a third aspect of the invention there is provided a sub-assembly for a cellular confinement system for soil, sand or other filler material, the sub-assembly formed of a plurality of interconnected cells of fabric material, at least some of the cells being provided in use with a skirt portion extending from a respective cell wall, said skirt portion being formed of a separate piece of material from such wall.

In accordance with a fourth aspect of the invention there is provided a sub-assembly for a cellular confinement system for soil, sand or other filler material, the sub-assembly formed of a plurality of interconnected cells of fabric material, at least some of the cells having at least one cell wall provided with an integral skirt portion. Preferably the fabric material of the cells and integral skirt portion is flexible.

It will be appreciated that sub-assemblies having skirt portions extending from the cell walls can form a stronger cellular confinement system than unreinforced sub-assemblies. The skirt portions can be used to guide and align the stacking of sub-assemblies of cells in several layers. Furthermore, as the extending skirt portions can overlap with the cell walls of an upper and/or lower sub-assembly in a stacked system, leakage of the filler material from between the sub-assemblies can be minimised.

As the fabric cells are interconnected with one another there is no need for additional joining means such as clips (though the use of such is not outside the scope of this invention). And unlike a system that is made up from separate joined panels, an interconnected cellular system is substantially uniform in its structural strength without any significant points of weakness.

The sub-assemblies are advantageously manufactured into an integral cellular structure such that construction and connection of cells on-site is not required, as is the case with gabions for example.

The use of a fabric material, which is preferably a flexible fabric material, to form a sub-assembly for a cellular confinement system in accordance with the invention without a wire mesh or wire cage support structure enables it to be flexible, easy to handle and relatively light. It can be flat-packed so that it is relatively compact to transport. The system may therefore be suitable for air freight and helicopter delivery to remote areas. For example, an ISO 40 ft (12 m) container sized 12.00×2.34×2.28 m (L×W×H) can hold enough fabric to erect a filled wall 2.0 m high, 2.0 m wide, and 900 m long. The maintenance requirements can be minimal and the life expectancy of the system can be relatively long as there are no metal, timber or concrete parts which would potentially be effected by cracking, spalling, splintering or corrosion.

A flexible fabric material that is preferably also permeable to water will allow the movement of water and nutrients thereby encouraging vegetation to grow in suitable confined materials such as soil. Such vegetated systems can provide increased strength through the root structure and result in a more natural finished appearance, compatible with the local environment and ecology. The fabric material may also enable more eco-friendly disposal of subassemblies or systems in accordance with the present invention.

The cellular subassemblies can be used to form flood protection barriers. After stopping the initial flood impact, water can drain through the preferably permeable fabric material of the cells, leaving a solid protective barrier.

A subassembly or cellular confinement system in accordance with the invention can have little attenuating effect on radio or radar signals, unlike systems having metal components. The subassemblies can therefore enable the construction of substantial physical barriers without affecting communications. Such systems may also have a reduced thermal signature for infrared detection.

Where the skirt portion is fixedly attached to the cell wall, strengthening and reinforcement of the system can be maximised. Leakage of the confined material between a cell wall and its skirt portion can be eliminated. The system can be provided to a user with the skirt portions pre-attached and ready for use, making it quicker and easier to stack layers of sub-assemblies of the cellular system.

It is preferred, at least in some embodiments, to attach the skirt portion(s) by gluing. It has been found that some hot melt glues are not appropriate for applications where the system is exposed to a wide range of ambient temperatures, e.g. in desert areas. A special adhesive is therefore preferred.

In other embodiments the skirt portion may be attached by stitching. This may be preferred where the material of the cells and/or skirt portions do not take well to adhesive. Of course, the skirt portions may be both glued and sewn if desired.

The skirt portions may be fixedly attached, either in advance or on site, by any convenient method including one or more of stitching, stapling, riveting, taping, gluing, hot welding, ultrasonic welding, etc. The preferred fixing method may depend on the respective materials of the cells and skirt portions. Many different methods of attachment are suitable as the location of the skirt portions is not particularly load bearing and the method of attachment is merely to hold the skirt portions in place and to prevent fill material from creeping between the skirt portions and the cell wall to which they are attached.

In one preferred embodiment the skirt portion(s) preferably comprise a skirting strip which is wrapped around at least part of the upper and/or lower perimeter of a first cellular subassembly. The skirting strip may be attached, e.g. by gluing or stitching, to the first cellular subassembly. When a second subassembly is stacked above or below the first, the skirting strip will overlap the two superimposed subassemblies but due to its length it may tend to gape. The skirting strip is preferably tacked onto the second subassembly so as to prevent it from gaping. This may be important where the skirting strip extends from an upper perimeter and needs to be kept standing vertical. Fastening the skirting strip to both upper and lower subassemblies may also help to strengthen the stacked system and reduce the risk of leakage. Such fastening may therefore be used with any skirt portions, whether a strip or otherwise, and whether overlapping on the inside or outside of the cell walls.

Conventional metal rivets, studs, staples, or similar fasteners may be used. However, it has been appreciated that metal fasteners are prone to corrosion and may not be suitable in some environments. They may also interfere with communications and could result in shrapnel if the cellular system is subjected to a blast. Thus in preferred embodiments the skirt portion(s) are fixed or attached to a cellular subassembly by plastic fasteners.

This feature is considered to be novel and inventive in its own right and thus from a further aspect the present invention provides a cellular confinement system for soil, sand or other filler material, the system comprising subassemblies each made up of a plurality of interconnected open cells of fabric material, the subassemblies being stackable one on top of the other, the system further comprising one or more skirt portion(s) which are arranged between vertically juxtaposed subassemblies in use to substantially prevent or minimise finer aggregate material escaping from between the stacked subassemblies, wherein the skirt portion(s) are fixed to at least one subassembly by plastic fasteners.

The fasteners are preferably self-holding, e.g. barbed plastic push-fasteners, plugs or studs. The fasteners themselves may be sharp so as to assist in penetration of the fabric material. Holes for the fasteners could be pre-formed in the material, but this would require alignment of holes in the skirt portions with holes in the walls. It is therefore preferred that a pilot hole is made in the fabric material layers as required e.g. using an appropriate puncturing tool. Of course, the plastic fasteners may be used alone or in conjunction with other fixing methods as described above.

A further advantage of the plastic fasteners is that they can be used to patch-repair a damaged cell wall. For example, where a cell wall has been breached or torn, the plastic fasteners can be used to tack a patch of fabric over the hole. From a yet further aspect the present invention provides a sub-assembly for a cellular confinement system for soil, sand or other filler material, the sub-assembly formed of a plurality of interconnected cells of fabric material, one or more of the cells being provided with a piece of fabric material fixed to the subassembly by one or more plastic fastener(s).

The piece of fabric material may form a seal against the escape of filler material from the subassembly. For example, the piece of material may comprise a patch. In other embodiments the piece of fabric material may form a reinforcing layer. In other embodiments the piece of fabric material may comprise a skirt portion. In all embodiments it is preferable that the piece of material is the same fabric material as the cells.

A yet further advantage of the plastic fasteners is that they can be used to attach together the walls and corners of subassemblies laid out side-by-side or otherwise tessellated in a layer. From a yet further aspect the present invention provides a cellular confinement system for soil, sand or other filler material, the system comprising subassemblies each made up of a plurality of interconnected open cells of fabric material, the subassemblies being stacked side-by-side in a layer with plastic fasteners joining together the walls of respective cells in adjacent subassemblies.

Where the skirt portion is formed of a separate piece of material from the cell walls, in accordance with the third aspect of the invention, the skirt portions can be selectively added to the system wherever reinforcement is required, for example at an outer perimeter. The separate skirt portions may be fixedly attached to the cells or removably retained therein. A user can therefore build his own confinement structure using a number of cellular sub-assemblies side-by-side and/or stacked on top of one another and choose the cells to which to add skirt portions. The skirt portions can be removed and reused as desired, especially where certain cells are damaged or where cells are removed to change the dimensions of the system. Where a skirt portion is found to have been damaged, it can be removed and replaced before filling or re-filling the system.

When forming a barrier structure the skirt portions may be used to provide selective reinforcement of the cells. This can be advantageous when forming a crash barrier or ballistic defence. In one preferred embodiment, the skirt portion(s) may be provided by an inner layer fitted inside selected cells of a subassembly. The cells therefore comprise a double layer of material. Preferably at least the outer perimeter cells of a system are provided with the inner layer. The inner layer preferably protrudes from the top and/or bottom of the cells to provide the seal between stacked layers. In a stacked system it may not be necessary for every subassembly layer to have protruding skirt portions. For example, if alternate subassemblies are provided with an inner layer which protrudes both top and bottom, then the subassemblies in between may be provided with an inner layer which fits between the skirt portions and merely acts as reinforcement.

From a further aspect the present invention provides a sub-assembly for a cellular confinement system for soil, sand or other filler material, the sub-assembly formed of a plurality of interconnected cells of fabric material, at least some of the cells being provided in use with an inner layer formed of a separate piece of material from the cells. The inner layer may be formed of the same material as the cell walls or of a different material. For example, the inner layer may be formed of a stiffer material for reinforcing purposes.

Preferably the inner layer is fixedly attached to the cell walls, for example by gluing or stitching. This is particularly preferred when the inner layer provides a skirt portion or portions. In some embodiments a reinforcing sheet or plate may be slid between the inner layer and an adjacent cell wall. The reinforcing sheet may be retained in the pocket formed between the inner layer and an adjacent cell wall of the same subassembly layer. In some embodiments the reinforcing sheet is preferably held between the skirt portion of a cell of a first subassembly and the adjacent cell wall of a vertically juxtaposed second subassembly. The skirt portion may be provided by an inner layer or may be otherwise formed, as described hereinabove.

The reinforcing sheet may be formed of metal (e.g. steel), plastic, ceramic, or a fibre reinforced material. Aramid fibres may be used to give ballistic rated protection.

The Applicants have appreciated that instead of using a full inner layer, only certain of the cell walls in a cellular subassembly may be provided with a double layer of fabric. The double layer can itself provide selective reinforcement of the structure, for example at the perimeter walls. Thus when viewed from a further aspect the present invention provides a sub-assembly for a cellular confinement system for soil, sand or other filler material, the sub-assembly formed of a plurality of interconnected cells of fabric material, at least some of the cells comprising a wall formed of two layers of the fabric material. Preferably a pocket is formed between the two layers and further preferably a reinforcing sheet or plate as above may be held in the pocket.

Where the skirt portion is formed integrally with a cell wall, in accordance with the fourth aspect of the invention, no extra assembly steps are required. The system can be provided as a one-piece unit. As the skirt portion is an integral part of the system it cannot be unattached other than by breaking the fabric of the cells.

Certain of the cell walls may be provided with an extending flap of material which can then be folded into the cell to at least partially separate the confined material in stacked layers and prevent it from leaking out. Folding of the skirt portion is possible due to the flexibility of the fabric material and provides a distinct advantage over cellular structures made from stiffer materials such as plastic or metal. Alternatively the extending flap can be tucked against an adjacent cell wall, either on the inside or outside. The extending flap may be held against the wall of a superimposed subassembly by plastic fasteners, as is described above.

It has been appreciated that by using flexible fabric skirt portions the skirt portions can be used to close the top or bottom of a subassembly, for example when it forms the upper or lower layer of stacked system. In some embodiments the cells of a subassembly may be provided with a skirt portion, whether a separate piece of retained material, a fixedly attached skirt portion or an integral skirt portion, which is able to fold down to close the top and/or bottom of the open cells. The skirt portion may comprise eyelets for receiving a drawstring in use, such that preferably the cells can be fastened closed by drawing together the skirt portions. Closure of the cells may be effected at either the top or bottom or both, to capture the fill material and to delay the escape of fill material in the event of impact, for example when a stacked system is used as a crash barrier or defence.

Additionally or alternatively, at least some skirt portions, e.g. at the perimeter of a subassembly or along an end wall, preferably comprise eyelets to facilitate fastening of adjacent subassemblies.

The skirt portions may be folded and/or attached over a framework where one is provided. They may also be folded and/or attached against an adjacent structure to help tether the system in place.

In accordance with all of the above-described aspects of the invention, the Applicants have realised that by providing a skirt portion which can extend substantially parallel to the cell walls and which will overlap with the cell walls of an adjacent sub-assembly in a stacked structure, it is possible to stack the fabric cell sub-assemblies directly one on top of the other and form a substantially vertical wall without the use of a wire mesh or wire cage support structure. This can be important for forming unclimbable defensive barriers and high walls which are not possible with known geotextile cellular systems. Vertical walls up to 10 m high can be built. Walls of any thickness and length can be produced to suit ballistic and vehicle impact requirements. Such a method of stacking a cellular confinement system is considered to be novel and inventive in its own right and thus when viewed from a further aspect the invention provides a method of forming a cellular confinement system for soil, sand or other filler material comprising providing a plurality of sub-assemblies of interconnected cells formed from a fabric material, providing at least some of the cells with a skirt portion and stacking the sub-assemblies such that the skirt portion extends between the cell walls in one of the sub-assemblies and the cell walls in another of the sub-assemblies.

A further aspect of the invention provides a method of assembling a barrier structure comprising providing a plurality of frameless sub-assemblies each formed of interconnected fabric cells, introducing filler material into the cells of a first sub-assembly laid on the ground, positioning a second sub-assembly on top of the first so that respective perimeters of the sub-assemblies align to provide a substantially vertical wall, forming a seal against escape of finer filler material between the sub-assemblies along the vertical wall, introducing filler material into the second sub-assembly, and repeating the above steps with further sub-assemblies stacked on top of the first and second to provide a vertical walled barrier structure of desired height. Of course, just two subassemblies may be required to form a barrier of the desired height.

It will be appreciated that in accordance with the invention a confinement system or barrier structure can be quickly assembled on the spot with minimal manpower and equipment required. A structure so formed can be filled with any locally available compactable material. For example, a wall 2.0 m high, 2.0 m wide and 10 m long can be completed in 1 hour using a four man crew and a fill-tipping bulldozer. Where sand is the confined material no compaction is necessary to produce a stable 2.0 in high structure.

Preferably skirt portions are used in at least one of the sub-assemblies to form the seal. The skirt portions may be either fixedly attached to the cell walls, formed of a separate piece of material and removably retained in the cells, or integrally provided by the cells. The respective advantages of these constructions have been discussed above.

The stacking and filling method can be adapted depending on the type of barrier structure required. Subassemblies may be stacked side-by-side as well as on top of one another. The overall size and shape of the barrier structure may therefore be tailored on site as required. Furthermore, the Applicants have appreciated that the cellular structure of the subassemblies advantageously allows a variety of different fill materials to be used within the same confinement system. Different fill materials can occupy different cells in each subassembly. This can lead to a vertical layering effect in terms of the fill material, giving the system selective barrier properties. For example, a more pliant fill material may be used in the front/outer or middle layers of cells with a more compact material such as sand in the back/inner layers of cells. In another example, stone may be used as the fill material in the front or outer layers, followed by air-filled cells, followed by sand in the back or inner layers. Different layering arrangements of fill materials may be selected so as to dissipate the energy of certain types of weapons. The layering of the fill materials may also be used in conjunction with selection of those cells provided with skirt portions. For instance, the outer cells around the perimeter of a system may be provided with interlocking skirt portions to give a more rigid shell whilst the innermost cells may not have any skirt portions and can act to absorb any impact.

From a further aspect the present invention provides a method of assembling a barrier structure comprising providing a plurality of cellular sub-assemblies each formed of interconnected fabric cells, introducing a first fill material into select ones of the cells of a first sub-assembly laid on the ground, introducing a second, different fill material into select other ones of the cells of the first sub-assembly, positioning a second sub-assembly on top of the first sub-assembly, introducing the same fill materials into corresponding cells of the second sub-assembly, and repeating the above steps as required with further sub-assemblies stacked on top of the first and second to provide a barrier structure of desired height. Of course, any number of different fill materials may be used in different sections of the cellular structure. The fill materials may also be varied both within a horizontal layer and a vertical layer. For example, lower layers could be filled with sand whilst upper layers are filled with a coarser material such as stone.

Some general features will now be described in accordance with all aspects of the invention. The sealing means, preferably comprising one or more skirt portions, may be provided on any number of the cells and associated with as many of the cell walls as desired. The seal may be formed at the inner or outer surface of the cell walls. A skirt portion extending around the whole perimeter of each cell e.g. a skirt ring or tube may be used for a maximal strengthening effect. At least in some preferred embodiments, therefore, the skirt portion is shaped to match the inner perimeter of a cell. Such skirt rings or tubes can be advantageously used to help open out the cellular structure and hold it in tension for filling.

In other preferred embodiments the sealing means, preferably comprising one or more skirt portions, does not extend around the whole perimeter of the cells. This can make it easier to insert the skirt portions into the cells or wrap them around the cell walls and possibly attach them to the cell walls. Where a separate skirt portion is provided per selected cell, the skirt portion may just extend across the width of each perimeter cell wall, e.g. a linear strip, however it is preferred that the skirt portion extends across the width of a perimeter cell wall and at least partly across an adjacent cell wall, e.g. a U-shaped strip. This can help to ensure that the skirt portion seals the corners between adjacent cells where leakage could otherwise occur. It also helps to strengthen the system while minimising material costs.

The greater the number of cells with sealing means or skirt portions, the greater the overall strength and impact resistance of the structure. By providing each cell with a skirt portion the cells can be guided into exact alignment with each other when being stacked.

However, in some embodiments it is preferred that only the cells at the perimeter of a sub-assembly are provided with sealing means or skirt portions. The sealing means or skirt portions can be used at the perimeter to provide the strength and leakage control needed to enable vertical stacking of the sub-assemblies. It may be easier to stack the subassemblies when the inner cells are free of skirt portions and exact alignment is not required across the whole system.

One advantage of being able to limit the skirt sections or portions to the perimeter only of the cell structure is that polymeric geogrids can be introduced at one or more horizontal layers between the cells to provide additional strength for the construction of particularly high structures.

It is further preferred that only the perimeter cell walls of the perimeter cells are provided with skirt portions. This can optimise the strength, stackability and leakage control of the system while minimising the material and manufacturing costs involved in adding the skirt portions.

A skirt portion may be associated with a number of cells in the system. For example, a skirt portion may take the form of a strip running along several perimeter cell walls. This could be achieved by attaching the strip to the fabric material before forming the interconnected cell structure, or by using a slotted strip which can be fitted inside a number of adjacent cells. Where the skirt portion is integral, the number of the cells having a skirt portion can be selected during manufacture of the cellular system, e.g. those cells intended to form the perimeter of the sub-assembly could be provided with a skirt portion.

In some embodiments each subassembly of interconnected cells may have a skirting strip fixedly attached around the outer perimeter of the subassembly, e.g. at the top and/or bottom of the subassembly. One such embodiment has already been described above. A continuous band of skirting material wrapping around the perimeter can provide additional strength and integrity to the structure. The skirting strip may be made of the same or different material as the cell walls. Where several sub-assemblies are provided side-by-side in a layer, the skirting strips can help to strength the system by providing reinforcement.

This feature is considered novel and inventive in its own right and thus when viewed from a further aspect the present invention provides a sub-assembly for a cellular confinement system for soil, sand or other filler material, the sub-assembly formed of a plurality of interconnected cells of fabric material, the sub-assembly being provided in use with a skirting strip around the perimeter cell walls.

The skirting strip may extend downwardly from subassemblies used in upper layers. However, it has been found simpler at least in some embodiments for all of the subassemblies to have an upwardly extending skirting strip so that the subassemblies can be used equally in the lowermost and upper layers in a stacked system. The skirting strip may be tucked inside the cell walls of an upper layer. Alternatively, the skirting strip may overlap and cover the external boundary between a lower and an upper layer. Such an external skirt portion may be preferred where the skirt portion is made of a less flexible material which cannot be easily tucked inside adjacent cells but is stiff enough to remain in a vertical position covering the boundary between layers. Fasteners such as plastic rivets may be used to fix the upstanding skirting strip against an upper layer, as has been described above.

In order to maximise the potential for tailoring the cellular system depending on its application, it is preferable in some embodiments that each skirt portion is associated with a single cell. The basic cellular system can therefore be manufactured according to known principles. Starting from a standard cellular system formed of a plurality of interconnected cells of fabric material, the number of cells requiring skirt portions can be determined on a case-by-case basis. For example, where a single cellular sub-assembly is stacked on top of one or more other sub-assemblies to form a wall, skirt portions may be added to the perimeter cells all the way around the sub-assembly. Where two or more sub-assemblies are intended to be placed side-by-side in a larger structure then only those cells which will form the perimeter of the structure as a whole may require skirt portions.

In some embodiments, it is preferred that the skirt portions are formed of the same fabric material as the cells. Where the skirt portions are attached to the cell walls this can help to ensure that the joining method is equally effective on the like parts. It can also ensure that the system responds uniformly to environmental conditions and, where the fabric is porous, water can be released through the whole system. Furthermore the skirt portions will not contribute disproportionately to the weight of the sub-assembly.

In preferred embodiments the skirt portion is made of a fabric material which is preferably flexible, but in some embodiments it is preferred that the skirt portion is formed of a stronger and/or stiffer fabric material to the cell walls. In other embodiments the skirt portions can be made of any suitable material, in particular a stiff material, to provide additional strengthening and prevention of fill material leakage. The skirt portion(s) can act to strengthen the cellular confinement system and are always such that they prevent or minimise the escape of fill material from between subassemblies. Where the skirt portions are formed of the same fabric material, preferably a flexible fabric material, as the cell walls, additional reinforcement may be provided by inner layers formed of a different material and/or strengthening plates between the skirt portions and adjacent cell walls. Such features are described hereinabove.

The cells may be formed of any suitable fabric material exhibiting strength and flexibility, including woven, knitted and nonwoven fibrous webs. The fabric preferably comprises a nonwoven material, further preferably a flexible nonwoven material. Such materials are often chosen for their durability. It is further preferred that the nonwoven is polypropylene-based. A particularly preferred material is a non-woven fabric from bi-component fibres, e.g. Terram 4000 (335 gsm) or other geotextiles manufactured by Terram Limited. One such suitable material comprises 70% polypropylene and 30% polyethylene. These materials have very good tensile strength, stiffness, puncture resistance and tear resistance, combined with flexibility. They may also be permeable to liquid.

Suitable fabric materials include spunbonded polypropylene nonwovens and other nonwoven and woven materials. Another example of a preferred material is Terram 400 gsm thermally bonded nonwoven.

In a preferred embodiment the interconnected cells are formed from a continuous strip of nonwoven material which is folded back and forth on itself, the folded layers being bonded to each other at spaced apart locations such that the material can be opened out into a cellular sub-assembly. Preferably the cells are formed by applying an adhesive between the folded layers. Joints formed in this way have been found to be as strong as the nonwoven material itself. A special adhesive is preferred which can retain its bonding strength across a wide temperature range including extreme cold and extreme heat as found in some countries of the world.

A disadvantage of subassemblies which are formed from a folded strip is that the ends of the strip must be removed or glued down. In other embodiments the interconnected cells are manufactured instead in discrete subassembly sections, each section comprising e.g. 12 interconnected cells. This can make it easier to attach an external skirt portion around the perimeter of the subassembly section. For example, when the cellular subassembly is not formed from a continuous length of fabric then an integral skirt portion may be formed around the perimeter of a cellular section by forming the perimeter cell walls from a wider piece of fabric.

The interconnected cells may be manufactured so as to have any suitable shape such as triangular, rectangular, etc.

The fabric material may be treated either during or post manufacture to improve certain properties and/or appearance. For example, where the system may undergo prolonged exposure to sunlight the UV resistance of the fabric may be enhanced by adding appropriate stabilisers. Once a cellular sub-assembly has been assembled into a structure and filled the outside surface can be treated on location to give it any appearance which blends into its surroundings or to enhance its resilience. The fabric may be coloured or covered in shrouding for camouflage purposes. The fabric may also be treated so as to be radar detectable.

Cellular sub-assemblies, confinement systems and barrier structures in accordance with the invention are suitable for confining any solid particulate material such as concrete, aggregate, ballast materials (e.g. brick, broken concrete, granite, limestone, sandstone, shingle, slag and stone), crushed rock, gravel, sand, clay, peat, soil, or any other convenient aggregate material e.g. snow or ice-bound aggregate. The invention has been found to be particularly beneficial for confining sand as the seal or skirt portions can provide the strength required for a dense fill and help prevent leakage of the fine particles. Even wind-blown or dune sand, generally considered unsuitable for construction, can be used.

The sub-assemblies can be made on any macroscopic scale, although the invention has been found to apply in particular to sub-assemblies having cell dimensions of the order 100-500 mm in diameter. The cells can be of any suitable shape and are preferably circular or polygonal in cross-section. In a preferred embodiment the cells are 500 mm in diameter and 500-750 mm deep. With cells of this size a sub-assembly can provide a high degree of confinement and improved shear strength, while still allowing for a human-sized structure to be built relatively quickly using only a few layers of cells. Furthermore it is apparent that even if one of the cells in a sub-assembly should be damaged or ruptured in some way, the amount of confined material lost can be relatively small compared to the system as a whole and the effect on the system's strength can also be minimal as the inner cells remain intact. Where ballistics are involved, the fabric sub-assembly also has the advantage that it will not create metal shrapnel if hit.

BRIEF DESCRIPTION OF THE DRAWINGS

Some preferred embodiments of the present invention will now be described, by way of example only, and with reference to the accompanying drawings in which.

DETAILED DESCRIPTION OF THE INVENTION

Figure 1A:
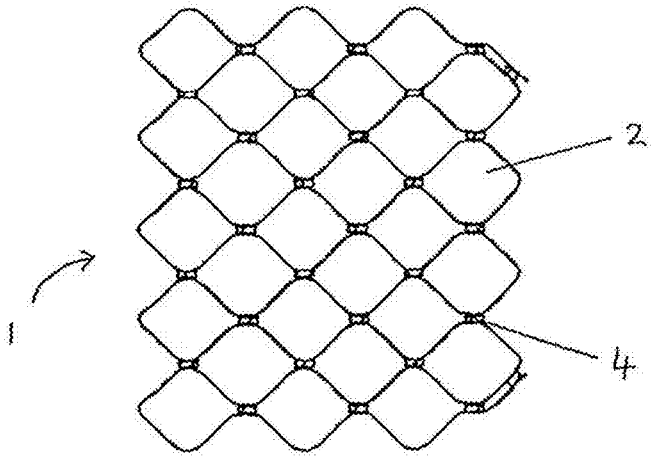
FIG. 1*a* shows a schematic plan view of a prior art cellular confinement system.
Figure 1B:
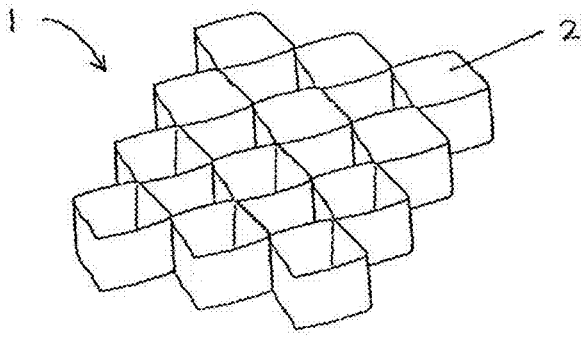
FIG. 1*b* shows a schematic perspective view of the system of FIG. 1*a;*

There is shown in FIGS. 1*a* and 1*b* a prior art three-dimensional cellular confinement system 1 comprising a number of interconnected cells 2 formed from a fabric material such as a nonwoven geotextile available from Terram Ltd. The cellular structure is formed by taking a 25 cm wide strip of nonwoven and folding it back and forth onto itself. Before each fold, adhesive is applied at a number of spaced apart locations 4 along the strip. The resultant pleated stack is then openable into a three-dimensional panel 1 having cells 2 formed by the folded layers between the adhesive locations 4. Adhesive joints formed in this way have been found to be up to 85% as strong as the nonwoven material itself. A special adhesive is preferred which can retain its bonding strength across a wide temperature range.

The resultant cellular system shown in FIG. 1*b* comprises a 3×4 array of cells 2 having dimensions of 25×25×25 cm. For civil engineering applications such as erosion protection the cell diameter is typically 25-45 cm and the cell depth is typically 10-15 cm. For example, the Erocell 25 product manufactured by Terram Ltd. is available in a panel measuring 10 m×7 m and containing around 1900 cells sized 25×25×10 cm. The flexible panel is collapsed into a flat state and rolled up for ease of delivery. Upon arrival at the site the panel is expanded and may be anchored. The panel may be pinned out on the installation surface to retain the open cell shape and size before filling. On slopes the panel is pinned down at every single cell around the perimeter and at staggered 1 m intervals across the centre of the panel.

Once the panel has been fixed and anchored in place, filling is carried out e.g. using a bulldozer to deposit soil, sand or other filler material as required. The cellular system confines the fill material within its strong geotextile cells. In soil stabilisation applications the cell structure restricts down-slope migration and provides erosion control. When filled with sands or granular fills, the cellular structure acts like a semi-rigid 'slab' distributing loads laterally, stabilising base materials, reducing subgrade contact pressures and minimising surface rutting. It also prevents the lateral displacement of infill and reduces vertical deflections even on low-strength subgrades. Geotextile cellular systems offer improvements over conventional stabilisation materials such as concrete and aggregate by confining the infill material in the strong cells while assuring effective subgrade drainage through the porous fabric. Such systems allow for vegetative growth which provides increased strength through the root structure and results in a more natural and environmentally-friendly result.

Figure 2:
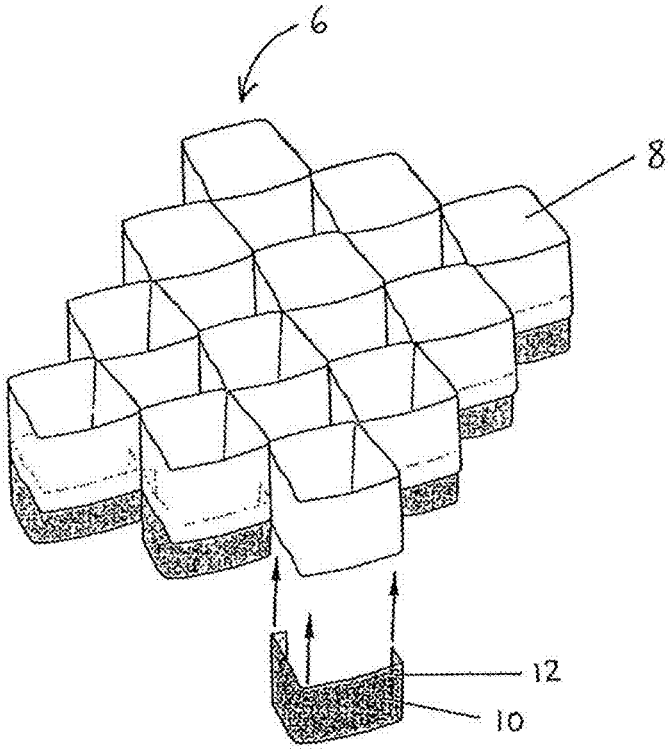
FIG. 2 shows a schematic perspective view of a cellular confinement sub-assembly in accordance with an embodiment of the present invention.

With reference to FIG. 2, a cellular confinement structure in accordance with an embodiment of the present invention comprises a sub-assembly 6 of interconnected cells 8 of a geotextile material such as is available from Terram Limited. In the embodiment shown, those cells 8 at the perimeter of the sub-assembly 6 are provided with a skirt band 10. The skirt band 10 is a strip formed of the same geotextile which has been cut to size to fit inside the cells. Each band 10 wraps around the interior surface of the cell walls, extending across those cell walls at the perimeter of the sub-assembly and partly extending across those cell walls at the interior of the sub-assembly. The band 10 is slotted in so as to partially overlap with the cell walls but is left to extend beyond the bottom of the cell so as to form an extending skirt. The cells are 50 cm deep while the skirt band is 15 cm deep, 6 cm of which is inserted into the cells to overlap with the cell walls and 9 cm of which is left protruding.

The skirt bands 10 help to guide and align the cells when stacking the sub-assemblies in several layers. They will extend into the cells of a lower sub-assembly and overlap with the cell walls of both sub-assemblies thereby preventing filler material from leaking out between the sub-assemblies.

The skirt band 10 may simply be slotted inside the cells 8. Although the material is flexible enough to bend the band 10 into the desired shape, it also sufficiently stiff that the band 10 will hold its shape and sit in the desired position inside the cell walls. Alternatively the bands 10 may be fixedly attached to the cells 8 by stitching or gluing along the line 12 shown. The line 12 is located about 1 cm down from the top of the skirt band 10. Gluing is a convenient fixing method and by using a special strong adhesive the joint between the skirt and the cell wall can be up to 85% as strong as the geotextile material from which they are made. Such adhesives have been found to retain their fixing strength across a wide range of temperatures.

One advantage of this embodiment is that the sub-assembly including any attached skirt strips is completely collapsible and can be transported flat. Large sub-assemblies can be collapsed and rolled up. The sub-assemblies are therefore very compact which aids transportation, and relatively light as they contain only geotextile. That said, when the sub-assemblies are opened out they form very stiff, strong structures.

Figure 3A:
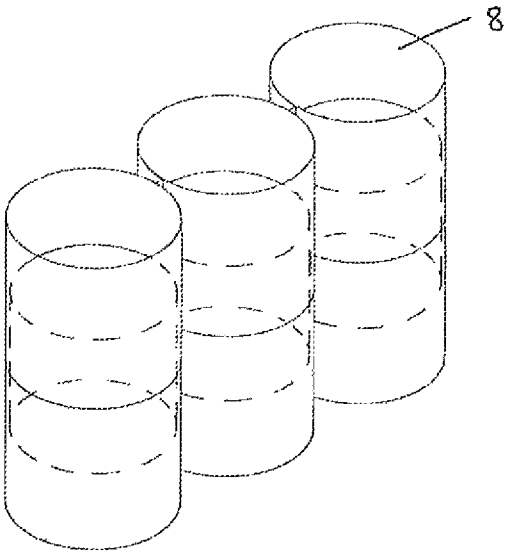
FIG. 3*a* shows a schematic perspective view of two stacked cellular confinement sub-assemblies in accordance with an alternative embodiment of the present invention and FIG. 3*b* shows an exploded view of the two stacked sub-assemblies of FIG. 3*a;*
Figure 3B:
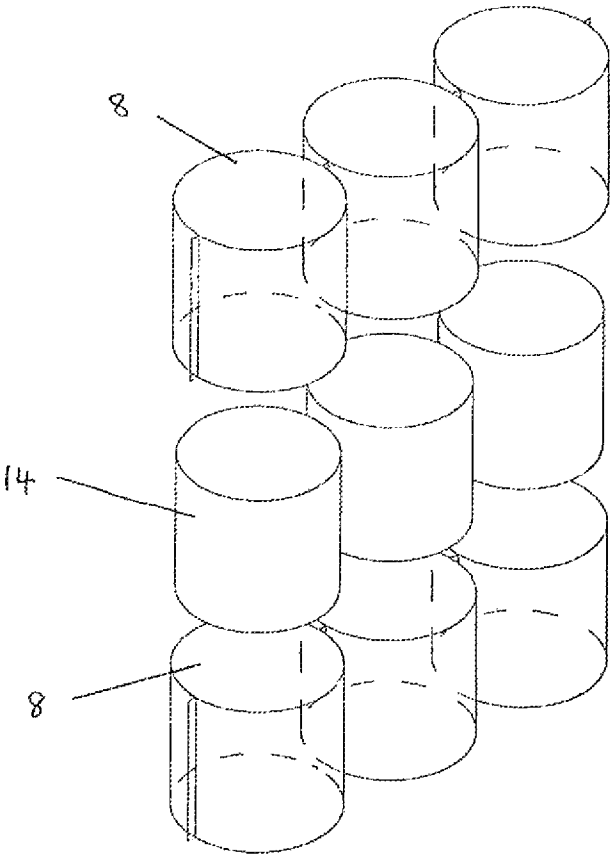

In the embodiment shown in FIGS. 3*a* and 3*b* the interconnected cells 8 are provided with skirt rings 14 which fit inside the cells and which are sized to fit snugly against the cell walls. The skirt rings 14 can be formed from a strip of the same geotextile as the cells 8, bent into the annular or polygonal perimeter shape of the cells and optionally fixed end-to-end. Alternatively the skirt ring 14 can be formed from a different material such as a stiff plastic, e.g. HDPE or PVC, for reinforcement purposes. Such a ring may be pre-moulded to match the size and shape of the cells. The complete skirt ring 14 has the benefit of holding each cell open and helping to tension the sub-assembly ready for filling. It guides the cells into alignment for stacking and is less likely to be accidentally folded down, which would impede filling.

Figures 4A, 4B:
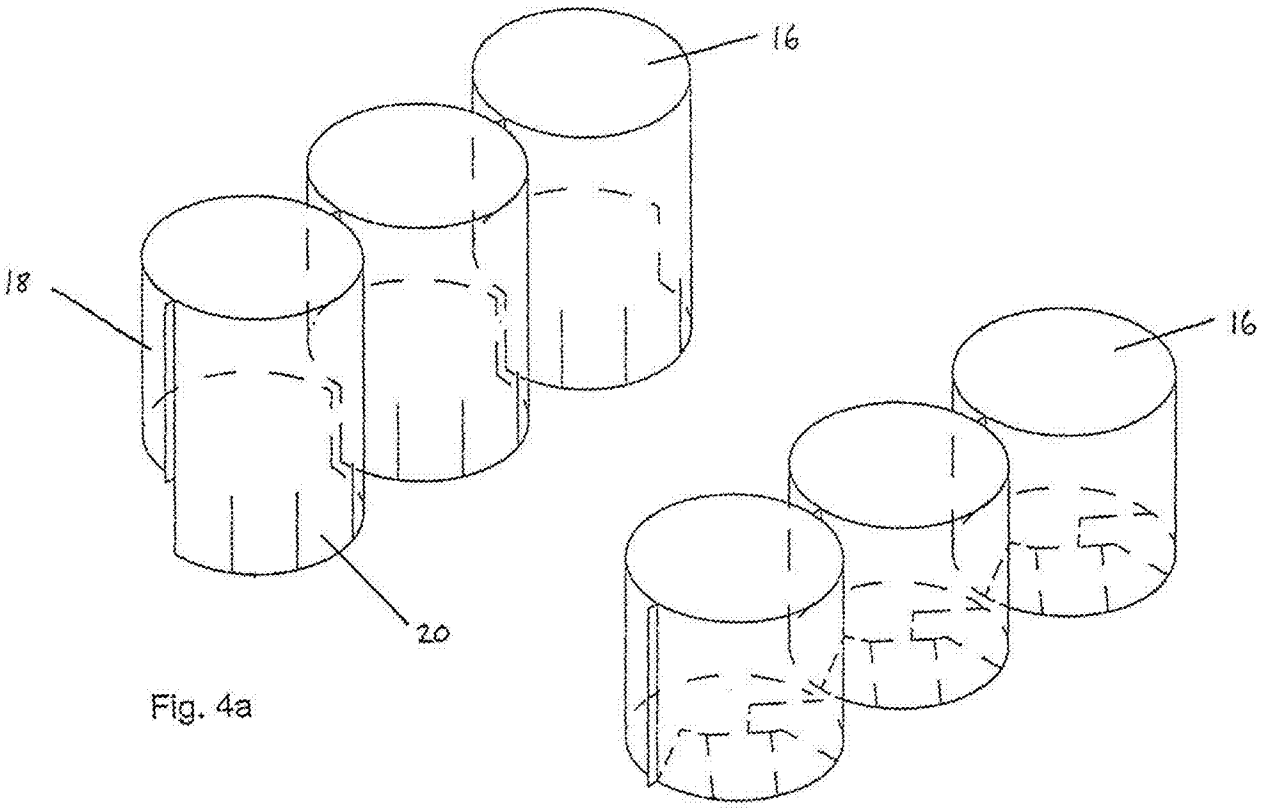
FIG. 4 shows a schematic perspective view of a cellular confinement sub-assembly in accordance with another alternative embodiment of the present invention.

Rather than a separate skirt band or ring being retained in or attached to the cells, the cell walls themselves may provide a skirting. In the modified embodiment shown schematically in FIG. 4*a* the perimeter cells 16 of a sub-assembly are provided with split wall dimensions. The interconnected cells are made from nonwoven geotextile as previously described. The inwardly-facing half of a perimeter cell 18 is of a standard depth matching the other cells in the system (not shown). The outwardly-facing half of a perimeter cell has an extended wall 20 which is deeper than standard. As is seen from FIG. 4*b*, the wall extension 20 can be folded into the cell 16 to provide a barrier between stacked sub-assemblies and to prevent filler material from leaking out. This embodiment can only be achieved as a result of the flexibility of the geotextile material.

Figure 5:
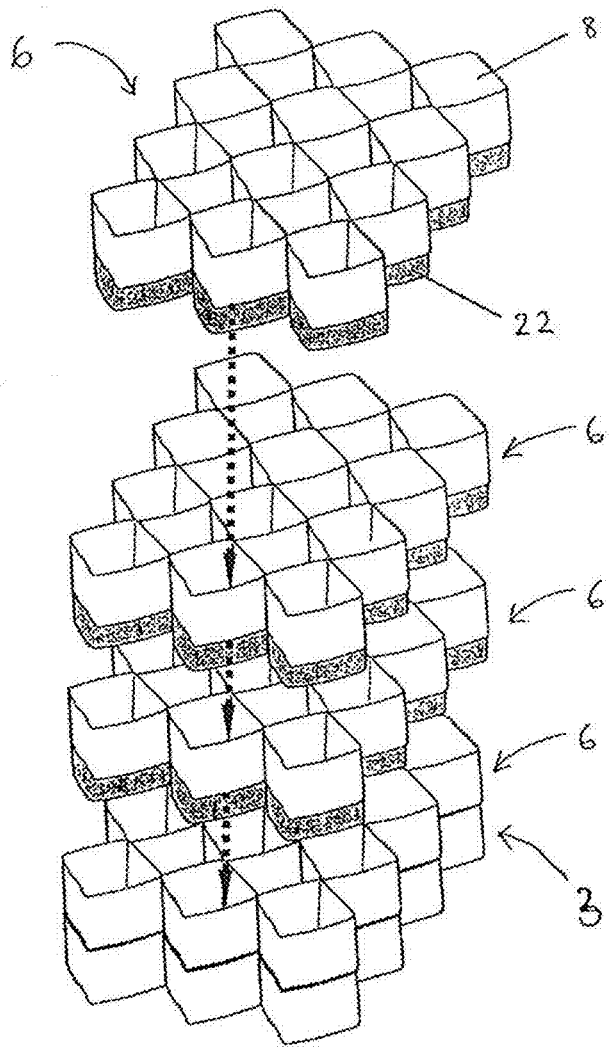
FIG. 5 shows a stacked structure formed from several of the sub-assemblies of FIG. 2.

Some methods of making cellular confinement systems and barrier structures will now be described with reference to FIGS. 5 and 6. The stacking of several sub-assemblies 6 is shown in FIG. 5. The base layer 3 is a standard cellular panel not having any skirt portions. On top of the base layer 3 there are stacked a number of sub-assemblies 6. The outer perimeter cells 8 in each sub-assembly 6 have a downwardly extending skirt 22 which overlaps with the cell walls in the vertically juxtaposed sub-assemblies to form a seal which prevents fine filler materials such as sand escaping from between the stacked sub-assemblies 6. The skirts 22 may partially or completely extend around the inside perimeter of the cells 8. The skirts 22 may be fixedly attached to the cell walls, e.g. by gluing, sewing or using plastic fasteners (described in more detail below). The protruding skirt 22 of each subsequent sub-assembly is used to guide the stacking. The skirts 22 are nested inside the cells above and below so as to cover and seal the boundary between sub-assemblies.

Each sub-assembly layer is filled before stacking the next layer. Starting from the bottom, the base panel 2 is laid out on the ground and filled up to a level about 10 cm from the top of the cells. This leaves room for the 9 cm long skirts 22 on the sub-assembly 6 which is stacked on top to fit down into the cells below. The sub-assembly 6 is positioned on top of the base panel 2 with the guidance of the skirts 22. The next fill tops off the base layer and fills the first sub-assembly 6 to a level about 10 cm from the top. The stacking and filling is repeated with further sub-assemblies 6 until the structure has reached the desired height. The uppermost sub-assembly is completely filled to the brim.

The stiffening effect of the skirts 22 allows the sub-assemblies 6 to be stacked directly on top of each other so as to form a structure having a vertical wall. In FIG. 5 there is shown the stacking of five sub-assemblies 6, each sub-assembly 6 having a depth of 50 cm, so as to form a wall structure 2.5 m high.

Figure 6A:
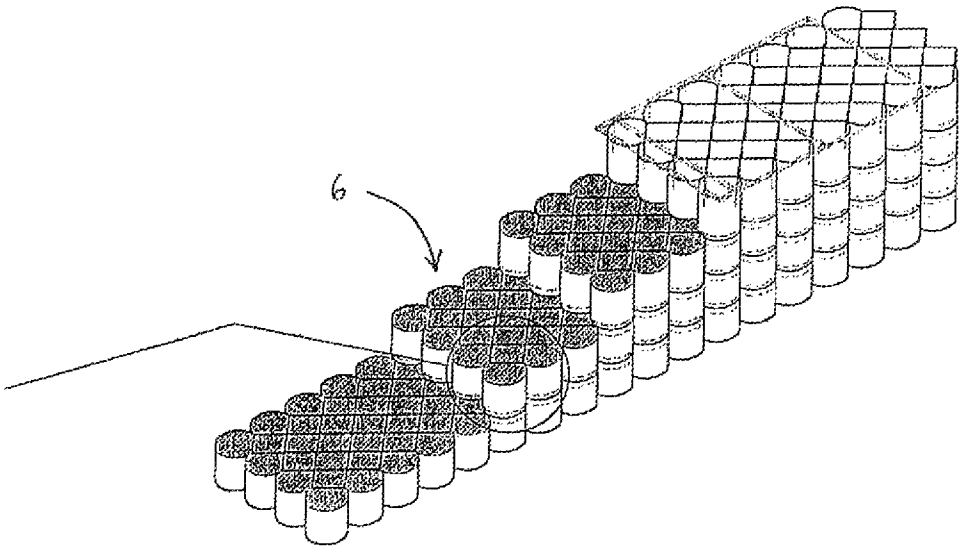
FIG. 6*a* shows a wall system constructed from four sub-assembly layers in accordance with an embodiment of the invention and FIG. 6*b* shows an enlarged view of part of the wall system of FIG. 6*a;*
Figure 6B:
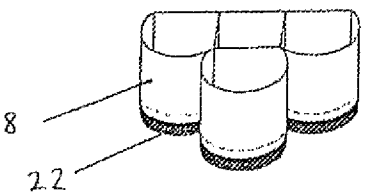

FIGS. 6*a* and 6*b* show a wall or defensive barrier formed by the above-described stacking technique. It will be appreciated that skirted cell sub-assemblies as described can be used to effectively confine even very fine particulate materials such as sand because the skirting prevents the sand from seeping out between the stacked sub-assemblies. This makes the sub-assemblies particularly suitable for desert environments where there are often no fill materials other than sand available. Sand is also desirable as a fill material due to the high density attainable without compaction.

The skirting provides the confinement necessary to enable stacking of the cellular sub-assemblies to form unclimbable vertical walls and high barriers. The guiding function of the skirts helps to facilitate stacking. Wall construction rates can be very rapid with little manpower required.

It will be appreciated that although the above-described embodiments only show downwardly-extending skirts, such skirts may equally be fitted to the top portion of a cell and extend beyond the top surface of a cellular sub-assembly. Indeed, a sub-assembly could have skirts fitted both at the top and bottom of the cells. This would allow for alternate layering of skirted and un-skirted sub-assemblies.

Figure 7:
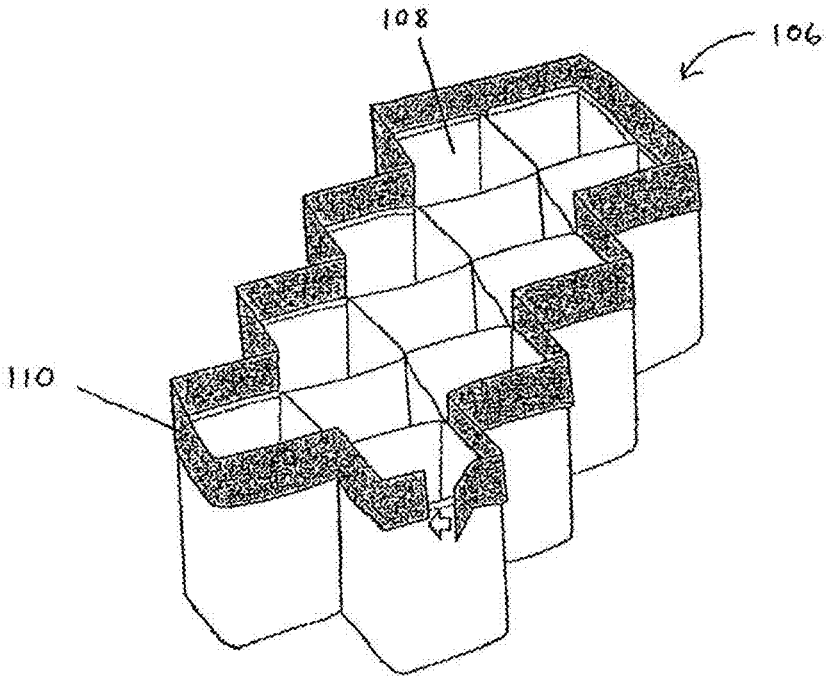
FIG. 7 shows a schematic perspective view of a cellular confinement sub-assembly in accordance with a further embodiment of the present invention.

With reference to FIG. 7 a cellular confinement system in accordance with a further embodiment comprises a sub-assembly 106 of interconnected cells 108 of a geotextile material. The sub-assembly 106 is manufactured as a discrete section containing 12 cells 108. The cells 108 are 50 cm deep. An external skirting strip 110 is fixedly attached around the perimeter of the sub-assembly 106. The skirting strip 110 is in intimate contact with each perimeter cell wall. The skirting strip 110 may be attached to the outside of the cells 108 by sewing or gluing along the dotted line shown. The attachment method used may depend on the respective material(s).

The skirting strip 110 is attached at the upper end of the sub-assembly 106, overlapping with the cell walls and extending upwardly. Typically the skirting strip is 15 cm deep, 5 cm of which is used to overlap with and attach to the cell walls while 10 cm is left protruding above the sub-assembly 106. The material of the skirting strip 110 is sufficiently rigid that the strip 110 stands vertically without substantially crumpling or bending.

Figure 8A:
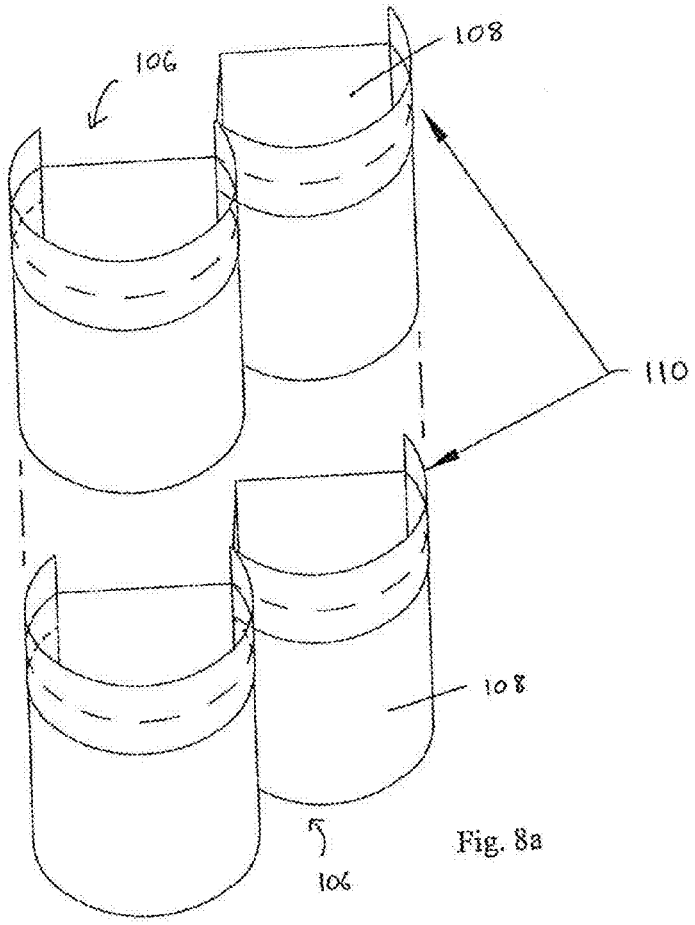
FIG. 8*a* schematically shows the stacking of two sub-assemblies and FIG. 8*b* shows a perspective view of a barrier structure formed by stacking the sub-assemblies.
Figure 8B:
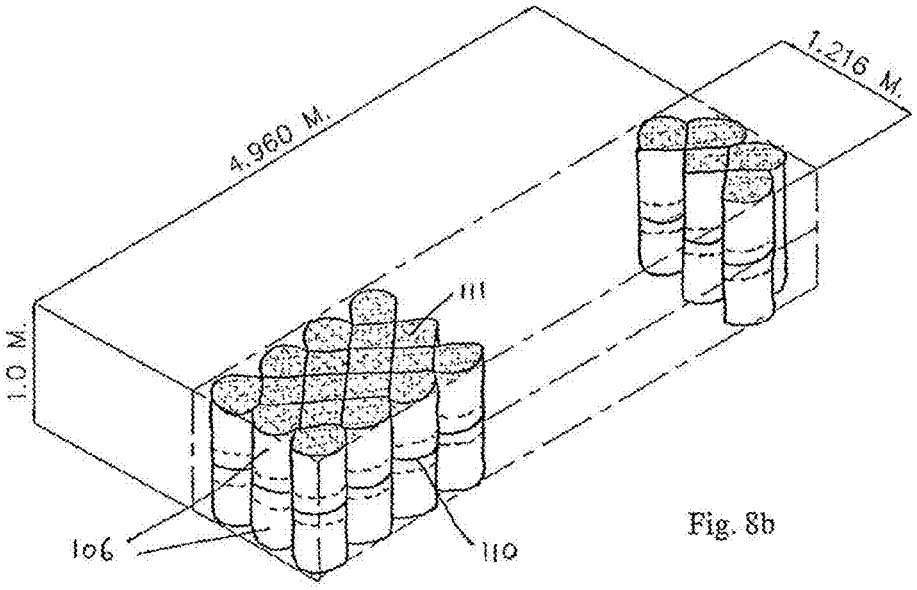

FIG. 8*a* illustrates the stacking of such sub-assemblies 106, the lower portion of the cell walls in an upper layer fitting inside the skirting strip 110 which extends around the perimeter of a lower layer. The resultant wall or barrier structure, as shown in FIG. 8*b*, has substantially vertical perimeter walls on all sides with a seal being formed by the skirting strips 110 between the vertically juxtaposed sub-assemblies 106. The fill material 111 e.g. sand is therefore prevented from leaking out between the stacked layers.

As the external skirting strip 110 extends upwardly, the same sub-assembly 106 can advantageously be used in any of the layers of a stacked structure. Thus a user does not need to select a different sub-assembly for the base layer. The sub-assemblies 106 can be stacked or deployed in any order and can be used the same way up in all of the layers, making it simpler to construct a stacked system. When a second sub-assembly 106 is stacked on top of a first, the lower end of the second sub-assembly 106 slots down inside the external skirting strip 110. The skirting strip 110 therefore overlaps the boundary between layers and prevents the escape of fill material. When a number of layers have been stacked, e.g. to form a wall or barrier, the skirting strip 110 on the top layer can be folded down to at least partially cover the exposed fill material.

It is also envisaged that the sub-assemblies 106 may be deployed inside an outer framework or support system, e.g. within a gabion. The upstanding skirting strip 110 on the uppermost layer may then be folded over or attached to the surrounding framework. For example, a mesh fence or plastic framework may be erected around a stacked system to protect the system from damage and to provide support for the stacked walls. It has been found that deployment of a cellular confinement sub-assembly inside a metal framework can provide enhanced performance under ballistic and blast testing as compared to a single confining layer of geotextile hung inside a metal framework.

Figure 9A:
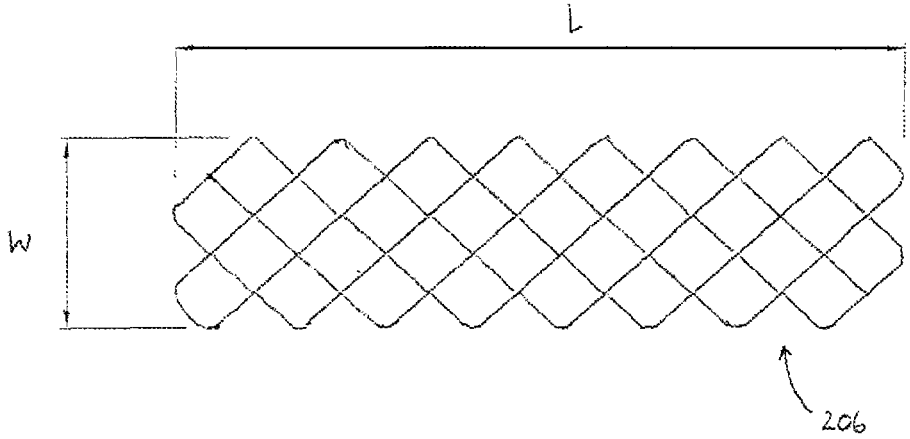
FIG. 9*a* shows a first embodiment of a cellular sub-assembly comprising a perimeter skirt in plan view and FIG. 9*b* shows the same cellular sub-assembly in perspective view.
Figure 9B:
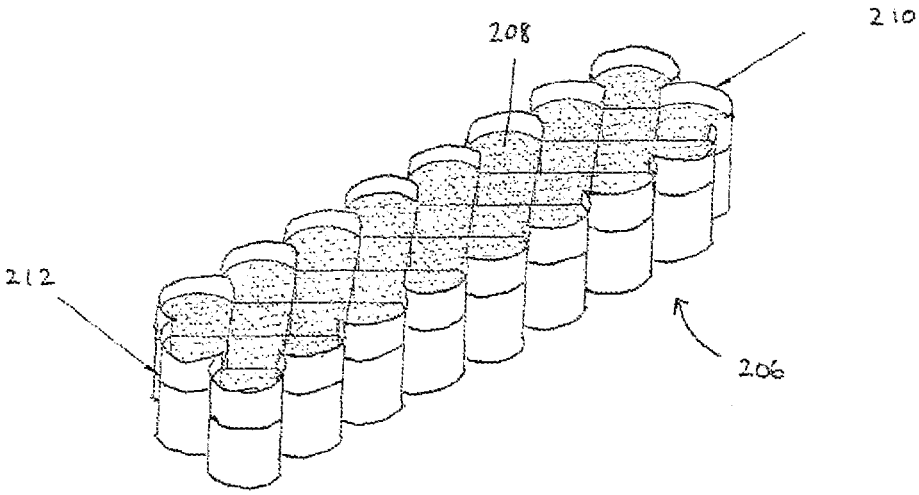

FIGS. 9*a* and 9*b* show a sub-assembly 206 of interconnected cells 208 made from Terram geotextile material. When opened out, the sub-assembly 206 has a width w of 1.25 m and a length l of 5 m. The cells 208 are 500 mm deep. An upstanding skirt 210 is provided around the upper perimeter of the sub-assembly 206. The skirt 210 extends 100 mm above the normal height of the cells, i.e. the effective height of the outer cell walls is increased from 500 mm to 600 mm. The perimeter skirt 210 may be integrally formed with the cell walls, or it may be a separate strip which is fixedly attached by sewing or gluing along the line 212. Such a perimeter skirt 210 can advantageously prevent the escape of fine fill material such as sand, while the absence of any skirt portions at the inner walls of the sub-assembly permit a high fill density and compaction of the fill material to be achieved.

Figure 10A:
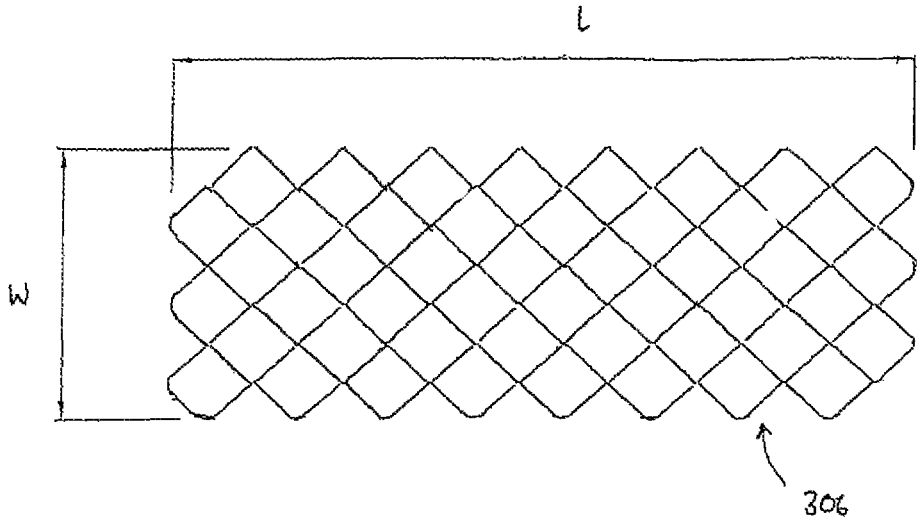
FIG. 10*a* shows a second embodiment of a cellular sub-assembly comprising a perimeter skirt in plan view and FIG. 10*b* shows the same cellular sub-assembly in perspective view.
Figure 10B:
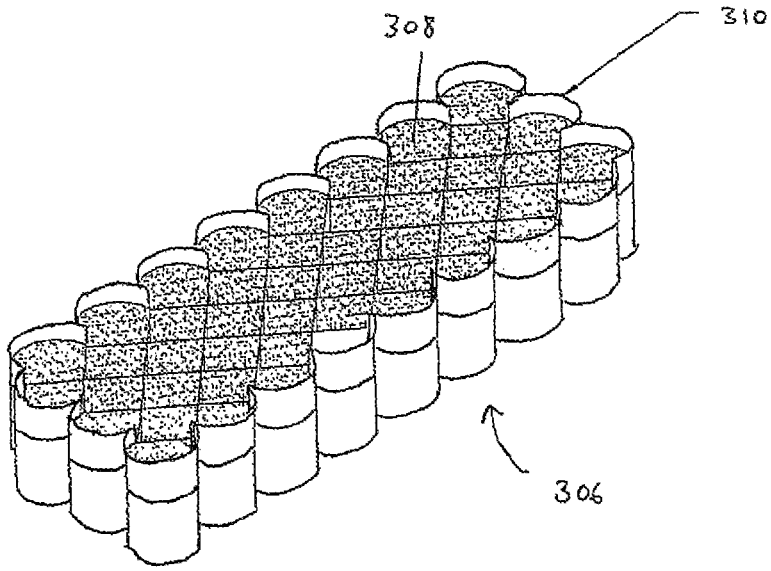

FIGS. 10*a* and 10*b* show another sub-assembly 306 of interconnected cells 308 made from Terram geotextile material. When opened out, the sub-assembly 306 has a width w of 1.75 m and a length l of 5 m. An upstanding skirt 310 is provided around the upper perimeter of the sub-assembly 306. Apart from the increased number of cells and size of the sub-assembly 306, it is substantially the same as the sub-assembly 206 shown in FIGS. 9*a* and 9*b*.

Figure 11A:
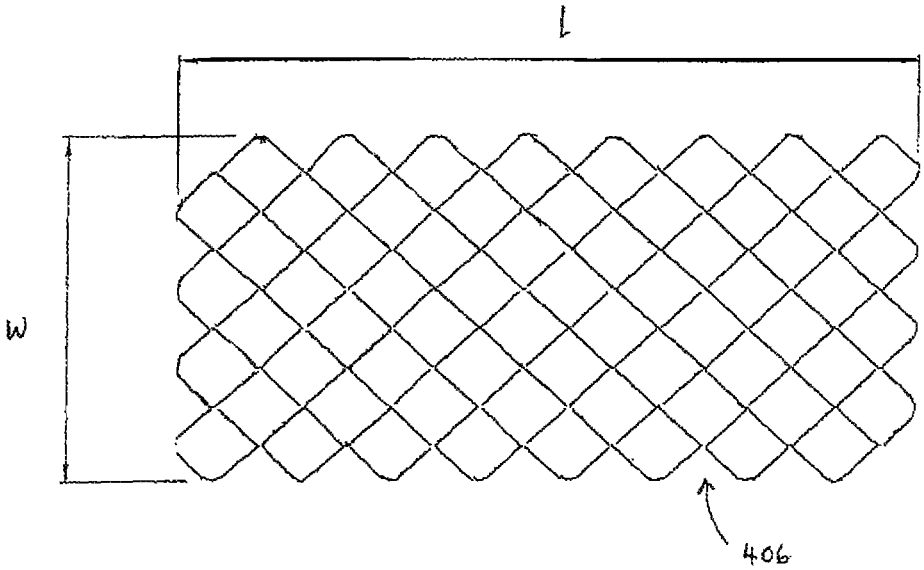
FIG. 11*a* shows a third embodiment of a cellular sub-assembly comprising a perimeter skirt in plan view and FIG. 11*b* shows the same cellular sub-assembly in perspective view.
Figure 11B:
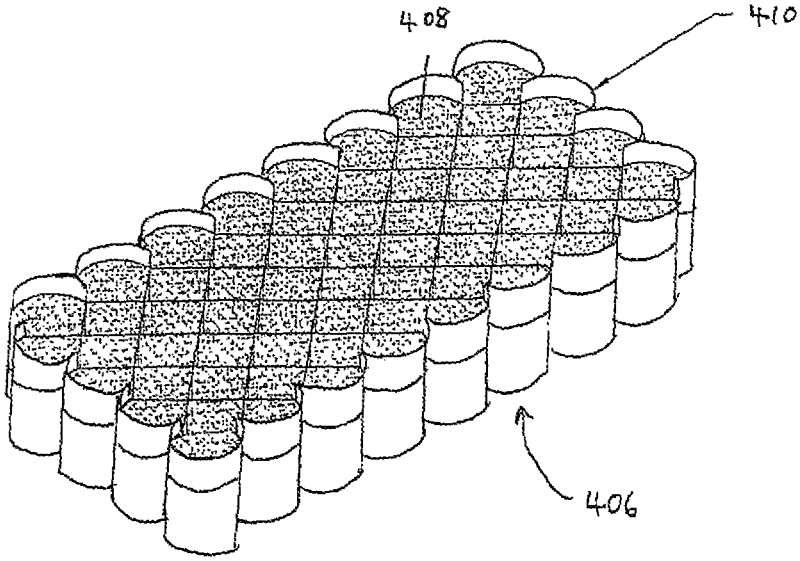

FIGS. 11*a* and 11*b* show another sub-assembly 406 of interconnected cells 408 made from Terram geotextile material. When opened out, the sub-assembly 406 has a width w of 2.25 m and a length l of 5 m. An upstanding skirt 410 is provided around the upper perimeter of the sub-assembly 406. Apart from the increased number of cells and size of the sub-assembly 306, it is substantially the same as the sub-assemblies 206 and 306 shown in FIGS. 9*a*-9*b* and 10*a*-10*b*.

Figures 12A, 12B, 12C:
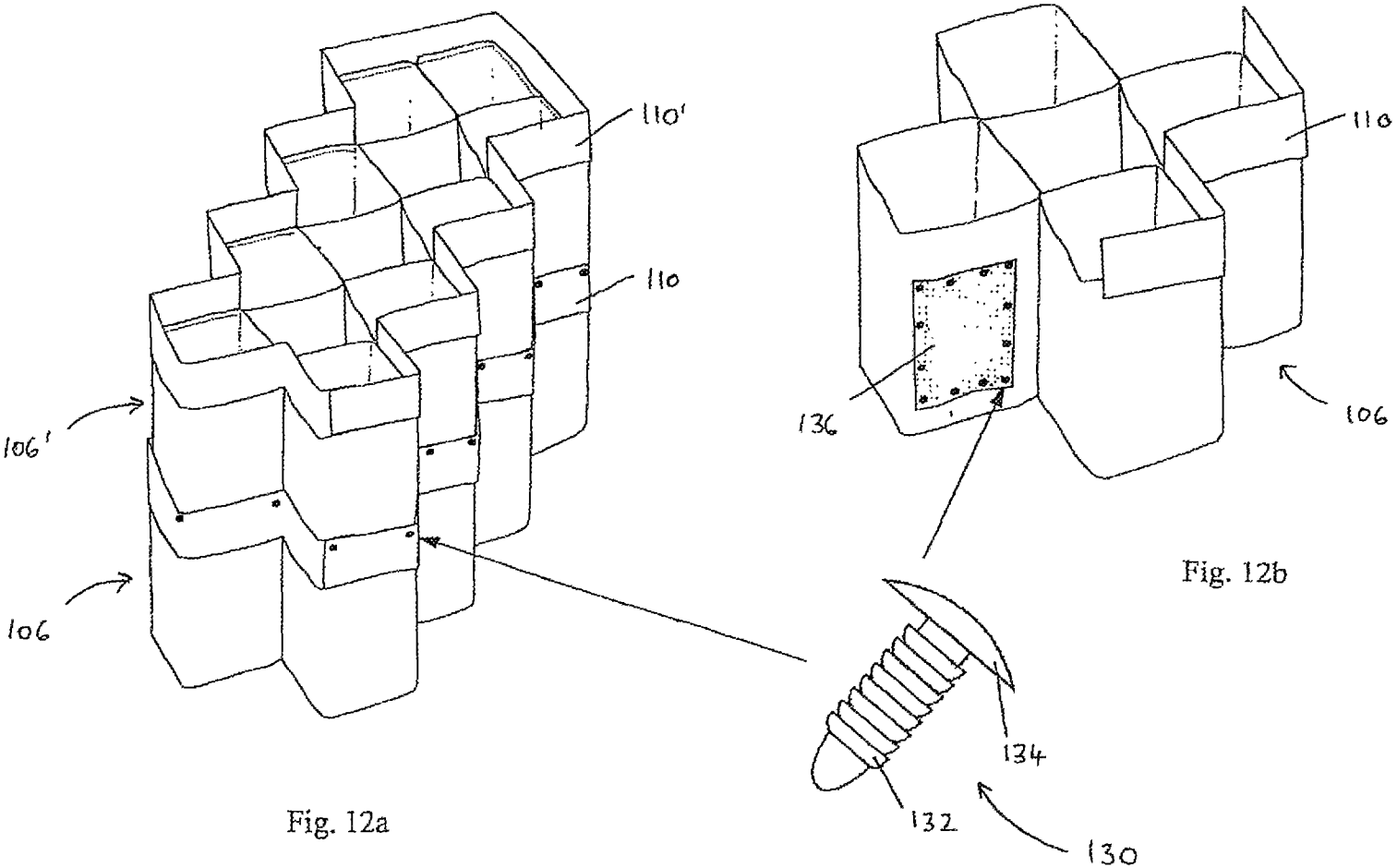
FIG. 12*a* shows a plastic fastener being used to fasten a skirting strip.
FIG. 12*b* shows a patch being attached by a plastic fastener.
FIG. 12*c* shows the plastic fastener in detail.

FIG. 12*a* illustrates the way in which fasteners 130 (seen in FIG. 12*c*), preferably made of plastic, may be used to attach a skirting strip 110 to the cell walls of a sub-assembly 106'. In the embodiment shown, a skirting strip 110,110' extends around the outer perimeter of each sub-assembly 106, 106' at its top edge. The skirting strips 110, 110' may be attached to the respective sub-assemblies 106,106' by any suitable method, such as gluing or sewing. They may be integrally formed with the cells instead of being a separate strip.

Where the skirting strip 110 of a lower sub-assembly 106 overlaps with the cell walls of an upper sub-assembly 106' which is stacked on top, fasteners 130 may be used to couple the overlying skirting strip 110 to the upper sub-assembly 106'. The fasteners 130 can advantageously prevent the skirting strip 110 from gaping away from the cell walls and ensure that the skirting strip 110 stands vertically. They can also help to strengthen the stacked system, e.g. where used as a crash barrier.

There is shown in FIG. 12*c* an exemplary plastic fastener 130 that comprises a stem 132 which is about 19 mm long and has a diameter of about 8 mm, and a head 134 with a diameter of about 18 mm. The fastener 130 is therefore rather small and unobtrusive. It may also pose little risk as shrapnel if the system is impacted or blown apart. The stem 132 of the fastener 130 is barbed such that the fastener 130 can hold itself in place once pushed through the fabric material of a skirting strip 110 and a sub-assembly cell wall. A pilot hole may first be made through the overlapping layers using a suitable tool, and then the fastener 130 may be pushed through the hole to hold the layers closely together. It is also envisaged that the fastener 130 itself may be sharp enough to be pushed through the material layers.

Another use of the plastic fastener 130 is shown in FIG. 12*b*. In this embodiment, the fasteners 130 are used to attach a patch 136 to repair a damaged cell wall in a sub-assembly 106.

Figure 13:
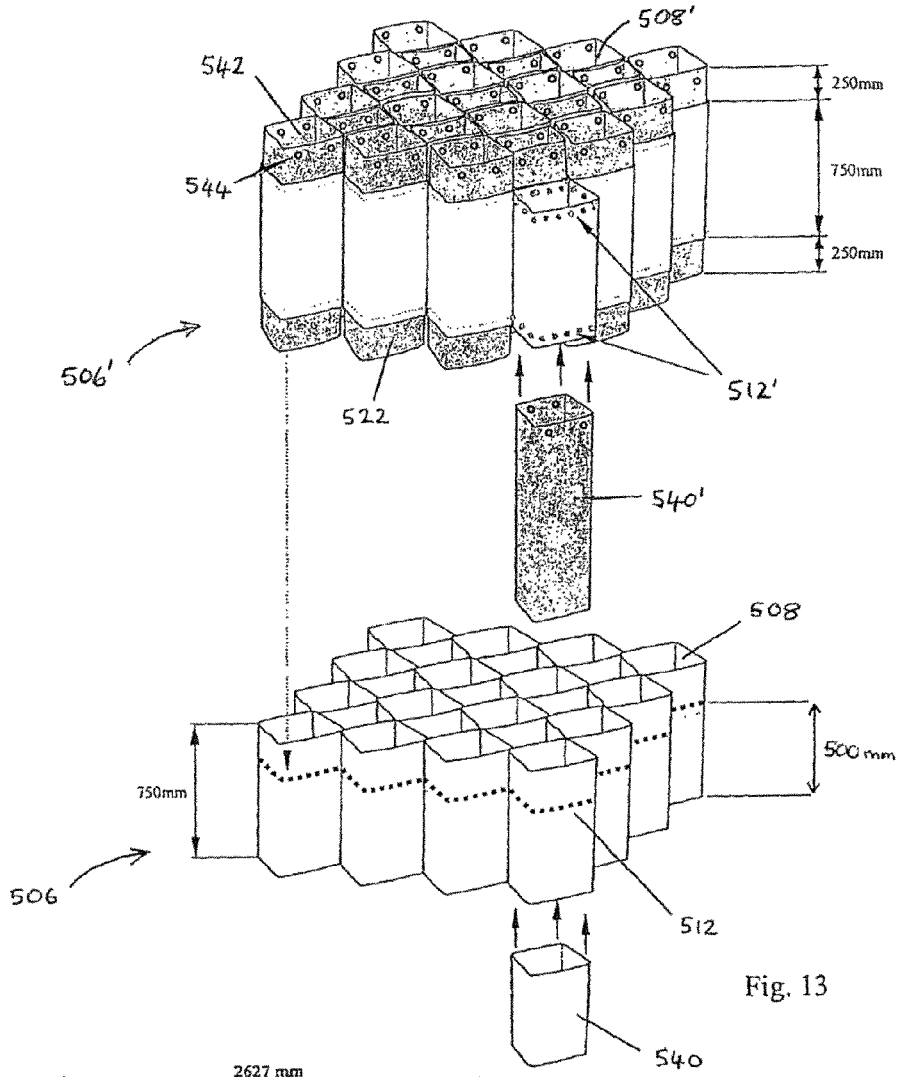
FIG. 13 shows a schematic perspective view of a cellular confinement system formed from sub-assemblies and inner tubes.
Figure 14:
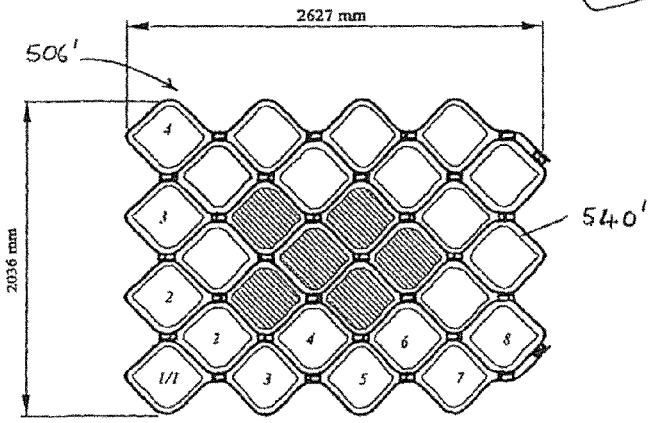
FIG. 14 shows a plan view of the system of FIG. 13.

With reference to FIGS. 13 and 14, stackable sub-assemblies 506, 506' according to an alternative embodiment comprise interconnected geotextile cells 508, 508' each of which are provided with a tubular insert 540, 540'. The inserts 540, 540' may be secured into each cell, for example by gluing or sewing along the lines 512, 512' shown. The inserts 540, 540' may be attached at the top and/or bottom of each cell. A reinforcing sheet (not shown) may be sandwiched between an insert 540, 540' and an adjacent cell wall, to provide further strengthening.

In certain sub-assembly layers, such as the base layer 506 in a stacked system, the tubular insert 540 has a depth which is less than the height of the cell 508. For example, the cells 508 may be 750 mm high while the insert 540 is only 500 mm deep. This can leave a depth of 250 mm at the top of each cell 508 which is free to receive a downwardly extending skirt 522 from an upper layer 506'. The insert 540 in these layers 506 can advantageously strength the system.

In other sub-assembly layers, such as an upper layer 506', the tubular insert 540' has a height greater than that of the cells 508'. The height of the insert 540' may be chosen depending on its location in the sub-assembly 506' and whether a skirt portion is desired at the top and/or bottom of the cells 508'. For example, where the cells are 750 mm deep, at least some of the inserts 540' may be 1250 mm deep, leaving a skirt portion 542 which is 250 mm deep extending out of the top of the cells 508' and a skirt portion 522 which is 250 mm deep extending out of the bottom of the cells 508'. Alternatively, the insert 540' may be 1000 mm deep so as to form a 250 mm deep skirt portion extending from only one end of the cells 508'.

When the layers 506, 506' shown are stacked on top of one another, the downwardly extending skirt portions 522 of the upper sub-assembly 506' slot into the cells 508 of the lower sub-assembly 506 and abut the inserts 540. As can be seen from the plan view of a sub-assembly 506' shown in FIG. 14, some of the inner cells 508' (shaded) can be provided with a 1000 mm insert 540' which provides only an upwardly extending skirt portion 542. These inner cells 508' do not, therefore, interlock with the cells 508 of the lower layer 506. This can make it easier to stack the sub-assemblies 506, 506'. However, all of the cells 508' in the upper sub-assembly are provided with top skirt portions 542. The upwardly extending skirt portions 542 can be used to interlock with another sub-assembly layer, for example another sub-assembly 506 without skirt portions which has been turned upside down so as to leave the 250 mm clearance at the bottom of the cells 508 to accommodate the up-skirts 542. However, in at least some embodiments the up-skirts 542 are used instead to close off the open cells 508' of the upper layer 506'. The upper skirt portions 542 are provided with eyelets 544. A drawstring (not shown) can be threaded through the eyelets 544 and used to pull the skirt portion 542 closed on top of each cell 508'. This is possible due to the flexibility of the geotextile material used for the inserts 540'. It will be appreciated that the inserts 540 in the base layer 506 may be formed of a stiffer material, e.g. for reinforcing purposes, as they do not form skirt portions or a closure system.

Cellular sub-assemblies used in embodiments of the present invention may be formed using any suitable technique. For example, they may be formed from a concertinaed strip of geotextile material as shown in FIG. 1. They may also be formed in discrete sections of interconnected cells.

Figure 15A:
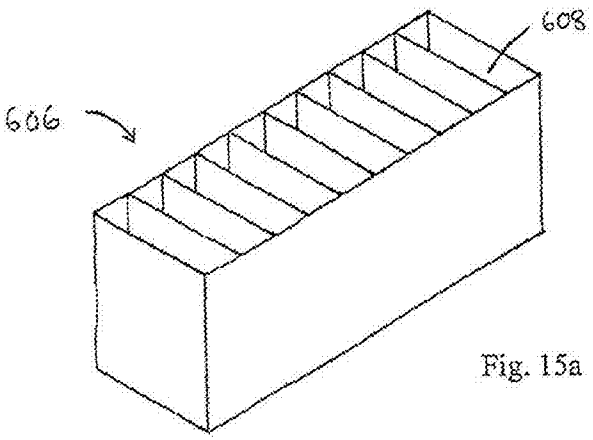
FIG. 15 shows rectangular cellular sub-assemblies in accordance with an alternative embodiment of the invention.
Figure 15B:
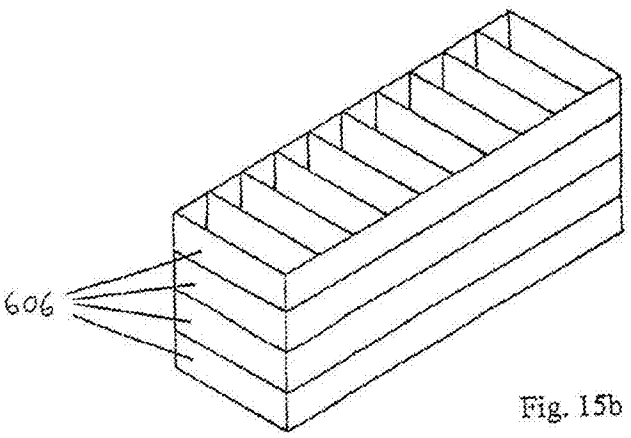

There is shown in FIG. 15*a* a cellular sub-assembly 606 formed of interconnected cells 608 having a generally rectangular shape. FIG. 15*b* shows a cellular confinement system for soil, sand or other filler material made up from a number of the sub-assemblies 606 stacked on top of one another to form generally vertical walls. Skirt portions, although not shown, may be used to seal at least the outer perimeter of the cells 608 from the escape of fill material between the layers.

Figure 16A:
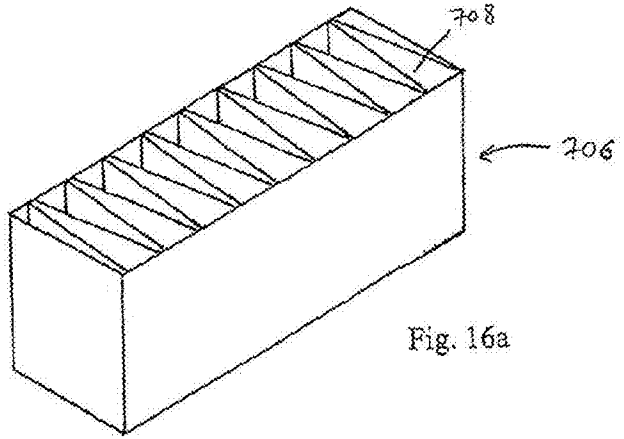
FIG. 16 shows triangular cellular sub-assemblies in accordance with another alternative embodiment of the invention.
Figure 16B:
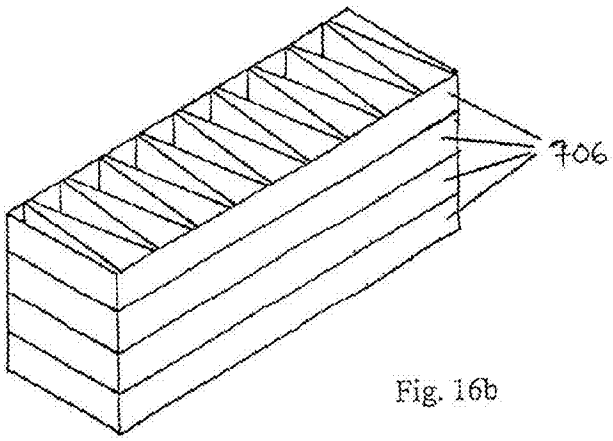

There is shown in FIG. 16*a* a cellular sub-assembly 706 formed of interconnected cells 708 having a generally triangular shape. FIG. 16*b* shows a cellular confinement system for soil, sand or other filler material made up from a number of the sub-assemblies 706 stacked on top of one another to form generally vertical walls. Skirt portions, although not shown, may be used to seal at least the outer perimeter of the cells 708 from the escape of fill material between the layers.

It will be appreciated that cells of any desired size and shape can be used. The cell shape may be adjusted, for example, to improve the overall strength of the cellular system.

Although geotextile materials such as those manufactured by Terram Ltd. have been described as being particularly suitable for forming sub-assemblies and cellular confinement systems, it will be appreciated that many different types of fabric material may be used in accordance with the invention. For example, geotextile materials manufactured by Fiberweb Inc. may also be used.

The invention claimed is:

1. A frameless cellular confinement system for soil, sand or other filler material, the system comprising sub-assemblies each made up of a plurality of interconnected open cells of fabric material, the sub-assemblies being stackable one on top of another to provide a structure having at least one generally vertical side or end wall, the system further comprising sealing means which is arranged between vertically juxtaposed sub-assemblies in use to substantially prevent or minimise finer aggregate material from escaping from between the stacked sub-assemblies at said generally vertical side or end wall, wherein the sealing means comprises one or more skirt portions comprising a skirting strip extending continuously around an outer perimeter of a respective said sub-assembly.

2. The system as claimed in claim 1, wherein the one or more skirt portions are formed of flexible fabric material.

3. The system as claimed in claim 1, wherein the one or more skirt portions extend from at least one of a top and a bottom of each sub-assembly.

4. The system as claimed in claim 1, wherein the one or more skirt portions overlap an inner or outer surface of the cells in one of said vertically juxtaposed sub-assemblies.

5. The system as claimed in claim 1, wherein each said skirt portion is integral with a respective sub-assembly.

6. The system as claimed in claim 1, wherein each said skirt portion is a separate piece of material fixedly attached to one or more cell walls.

7. The system as claimed in claim 1, wherein separate skirt portions are provided for respective cells.

8. The system as claimed in claim 7, wherein each said skirt portion comprises a skirt ring or tube at least partially inserted inside a respective cell so as to leave the each said skirt portion extending from at least one of a top and a bottom of the respective cell.

9. The system as claimed in claim 7, wherein each said skirt portion comprises the skirting strip at least partially inserted inside a respective cell so as to leave at least part of the each said skirt portion extending from at least one of a top and a bottom of at least one perimeter wall of the respective cell.

10. The system as claimed in claim 1, wherein said one or more skirt portions are associated with the cells at a perimeter of the system or a respective said sub-assembly.

11. The system as claimed in claim 1, wherein said one or more skirt portions form part of an inner reinforcement layer fitted inside selected cells of a respective said sub-assembly.

12. The system as claimed in claim 1, wherein a reinforcing sheet is held between the one or more skirt portions of the plurality of interconnected open cells of a first sub-assembly and an adjacent cell wall of a vertically juxtaposed second sub-assembly.

13. The system as claimed in claim 1, wherein the skirting strip wraps around the outer perimeter of a respective said sub-assembly.

14. The system as claimed in claim 1, wherein the skirting strip of a first sub-assembly is fastened to one or more cell walls of a second, vertically juxtaposed sub-assembly in use.

15. The system as claimed in claim 14, wherein the skirting strip is fastened to the cell walls using fasteners made of a plastics material.

16. The system as claimed in claim 1, wherein the plurality of interconnected open cells are formed of a nonwoven fabric material.

17. The system as claimed in claim 1, wherein each of said sub-assemblies is made up of said plurality of interconnected open cells in a discrete sub-assembly section with a respective said skirt portion around an outer perimeter of the sub-assembly section.

18. A method of assembling a barrier structure comprising providing a plurality of sub-assemblies formed of interconnected open cells of a fabric material, introducing a filler material into the cells of a first sub-assembly laid on the ground, positioning a second sub-assembly on top of the first sub-assembly so that respective perimeters of the first and second sub-assemblies align to provide a substantially vertical wall, providing a skirting strip between said first and second sub-assemblies so as to extend continuously around an outer perimeter of said substantially vertical wall and form a seal against escape of finer filler material between the first and second sub-assemblies along the vertical wall, introducing the filler material into the second sub-assembly, and repeating the above steps as required with further sub-assemblies stacked on top of the first and second sub-assemblies to provide the vertical walled barrier structure of desired height.

19. The method as claimed in claim 18, wherein the skirting strip is a separate piece of material and forming the seal comprises fastening the skirting strip to the vertical wall across the boundary between the plurality of sub-assemblies.

20. The method as claimed in claim 18, wherein the skirting strip is integral with one of the first and second sub-assemblies and forming the seal comprises overlapping the skirting strip from the one of the first and second sub-assemblies to extend over a portion of another of the first and second sub-assemblies.

* * * * *